US005513968A

United States Patent [19]

Ochiai

[11] Patent Number: 5,513,968

[45] Date of Patent: May 7, 1996

[54] INSPECTION SYSTEM FOR A DEFECTIVE ROTATION PREVENTING DEVICE IN AN ORBITING MEMBER OF A FLUID DISPLACEMENT APPARATUS

[75] Inventor: Yoshihiro Ochiai, Tomioka, Japan

[73] Assignee: Sanden Corporation, Isesaki, Japan

[21] Appl. No.: 221,927

[22] Filed: Apr. 1, 1994

[30] Foreign Application Priority Data

Apr. 2, 1993 [JP] Japan ..... 5-076745

[51] Int. Cl.[6] ..... F01C 1/04

[52] U.S. Cl. ..... 418/55.3; 418/151; 29/888.022

[58] Field of Search ..... 418/55.3, 151; 29/888.022

[56] References Cited

U.S. PATENT DOCUMENTS 4,411,604 10/1983 Terauchi ..... 418/149

4,548,556 10/1985 Terauchi ..... 418/57

4,552,517 11/1985 Shimizu ..... 418/57

5,141,422 8/1992 Ito et al. ..... 418/55.3

*Primary Examiner*—John J. Vrablik

*Attorney, Agent, or Firm*—Baker & Botts

[57] ABSTRACT

An inspection system for a rotation preventing device comprises a balance weight member disposed within a hollow portion of the compressor housing and at least one recessed portion formed in an annular surface of the hollow portion. If, during the assembly of the compressor, a ball from the rotation preventing/thrust bearing device rolls into the hollow portion or is accidentally dropped into the hollow portion, the balance weight member pushes the ball along the annular surface until it falls into the recessed portion. Further rotation of the balance weight locks the ball within the recessed portion, thereby preventing further rotation of the drive shaft. Therefore, defects in assembly due to the rotation prevention mechanism may be easily detected.

12 Claims, 6 Drawing Sheets

INSPECTION SYSTEM FOR A DEFECTIVE ROTATION PREVENTING DEVICE IN AN ORBITING MEMBER OF A FLUID DISPLACEMENT APPARATUS

BACKGROUND OF THE INVENTION

1. Field of the Invention

The present invention relates to a scroll type fluid displacement apparatus, and more particularly, to an improvement in the rotation preventing mechanism in a scroll type fluid displacement apparatus.

2. Description of the Prior Art

A scroll type fluid displacement apparatus is well known in the prior art. For example, U.S. Pat. No. 4,892,469 issued to McCullough discloses a basic construction of a scroll type fluid displacement apparatus.

Referring to FIGS. 1, 2 and 3, a scroll type fluid displacement apparatus in accordance with the prior art is shown in the form of scroll type refrigerant compressor unit 1. Throughout this description the terms "front" and "rear" are used to assist in the description. These terms are in no way intended to limit the description. With reference to FIG. 1, the left of the figure is referred to as the "front" and the right as the "rear." Compressor unit 1 includes housing 10 having front end plate 11 and cup shaped casing 12 which is attached to an end surface of front end plate 11. Opening 111 is formed in the center of front end plate 11 for the penetration of drive shaft 13. Annular projection 112 is formed in the rear end surface of front end plate 11 and is concentric with opening 111. An outer peripheral surface of annular projection 112 extends into cup shaped casing 12. Thus, the open end of cup shaped casing 12 is covered by front end plate 11. O-ring 14 is placed between the outer peripheral surface of annular projection 112 and the inner wall of the open end of cup shaped casing 12 to seal the mating surfaces therebetween.

Front end plate 11 has an annular sleeve 15 projecting from the front end surface thereof. Annular sleeve 15 surrounds drive shaft 13 and forms shaft seal cavity 60. Annular sleeve 15 is formed separately from front end plate 11, and is attached to the front end surface of front end plate 11 by screws (not shown). O-ring 16 is placed between the front end surface of front end plate 11 and rear end surface of sleeve 15 to seal the mating surfaces therebetween. Alternatively, sleeve 15 may be formed integrally with front end plate 11.

Drive shaft 13 is rotatably supported by annular sleeve 15 through bearing 17 located near the front end of annular sleeve 15. Drive shaft 13 has a disk portion 18 at its inner end portion which is rotatably supported by front end plate 11 through bearing 19 located within opening 111. Shaft seal assembly 20 is coupled to drive shaft 13 within shaft seal cavity 60.

Pulley 21 is rotatably supported by bearing 22 which is disposed on the outer surface of sleeve 15. Electromagnetic coil 23 is fixed around the outer surface of sleeve 15 by support plate 24 and is received in an annular cavity 61 of pulley 21. Armature plate 25 is elastically supported on the outer end of drive shaft 13. Pulley 21, magnetic coil 23 and armature plate 25 form magnetic clutch 62. In operation, drive shaft 13 is driven by an external power force, for example the engine of the automobile, through a rotational force transmitting device, such as magnetic clutch 62.

A number of elements are located within the inner chamber of cup shaped casing 12, including fixed scroll 26, orbiting scroll 27, a driving mechanism for orbiting scroll 27 and rotation prevention/thrust bearing device 37 for orbiting scroll 27. The inner chamber of cup shaped casing 12 is formed between the inner wall of cup of shaped casing 12 and the rear end surface of front end plate 11.

Fixed scroll 26 includes circular end plate 261, wrap or spiral element 262 affixed to or extending from one end surface of end plate 261 and a plurality of internally threaded bosses 263 axially projecting from the other end surface of circular end plate 261. Fixed scroll 26 is secured within the inner chamber of cup shaped casing 12 by screws 28, which screw into internally threaded bosses 263, from outside of cup shaped casing 12. Circular end plate 261 of fixed scroll 26 partitions the inner chamber of cup shaped casing 12 into front chamber 29 and rear chamber 30. Seal ring 31 is disposed within a circumferential groove in circular end plate 261 to form a seal between the inner wall of cup shaped casing 12 and the outer surface of circular end plate 261. A hole or discharge port 264 is formed through circular end plate 261 at a position near the center of spiral element 262. Discharge port 264 creates fluid communication between the central fluid pockets of spiral element 262 and rear chamber 30.

Orbiting scroll 27, which is located in front chamber 29, includes circular end plate 271 and wrap or spiral element 272 affixed to or extending from one end surface of circular end plate 271. Orbiting scroll 27 is supported by bushing 34 through bearing 35 placed between the outer peripheral surface of bushing 34 and an inner surface of annular boss 273 axially projecting from the front end surface of circular end plate 271. Bushing 34 is rotatably connected to the inner end of disk 18 at a point radially offset or eccentric to the axis of drive shaft 13. Drive shaft 13, which is rotatably supported by annular sleeve 15 through ball bearing 17, is integrally formed with disk 18. Disk 18 is rotatably supported by front end plate 11 through ball bearing 19 disposed within opening 111. Drive pin 41 projects axially from the rear end surface of disk 18 and is radially offset from the center of drive shaft 13. Bushing 34 is rotatably secured to drive pin 41 by snap ring 44.

Bushing 34 has balance weight 341, which is shaped as a disc or ring, extending radially along a front surface thereof. Balance weight 341 is secured to the front surface of bushing 34 by rivets 46 (FIG. 2), and generates a centrifugal force that opposes the centrifugal force generated by orbiting scroll 27. The centrifugal force generated by balance weight 341 is slightly higher than the centrifugal force due to the orbital motion of orbiting scroll 27 and the parts orbiting with it. Balance weight 341 has weight member 342 shaped as an arc (FIG. 2) and secured thereto by rivets 47. Balance weight 341 is accommodated in a hollow portion 50 which is formed between front end plate 11, bearing 19, disk 18 and annular boss 273. Eccentric hole 44 (FIG. 2) and balanced hole 42 are formed in bushing 34 at a position radially offset from the center of bushing 34. Drive pin 41 fits into eccentric hole 44 within which a bearing (not shown ) may be applied. Bushing 34 is therefore driven in an orbital path by drive pin 41 and can rotate within needle bearing 35. Bushing 34 thus functions as a linkage member to drivingly connect orbiting scroll 27 to drive shaft 13 and drive pin 41.

A rotation preventing/thrust bearing device 37, which is disposed around annular boss 273, is operatively coupled to orbiting scroll 27. Orbiting scroll 27 is permitted to orbit without rotating, thereby compressing fluid passing through the compressor unit.

More specifically, spiral element 272 of orbiting scroll 27 is radially offset from the spiral element 262 of fixed scroll 26. Orbiting scroll 27 undergoes orbital motion upon the rotation of drive shaft 13. As orbiting scroll 27 orbits, spiral elements 262 and 272 remain in contact. The fluid pockets, which are defined between spiral elements 262 and 272, move to the center with consequent reduction in volume and compression of the fluid in the fluid pockets. The fluid or refrigerant gas which is introduced into front chamber 29 through inlet port 31, is taken into the outer fluid pockets formed between spiral elements 262, 272. As orbiting scroll 27 orbits, the fluid is compressed and finally discharged into rear chamber 30 through discharge port 264. The fluid then exits the compressor through outlet port 32.

Rotation preventing/thrust bearing device 37 includes a fixed portion, an orbital portion and bearings, such as a plurality of balls 377. Fixed portion includes annular race 371 placed within an annular groove formed on the axial rear end surface of annular projection 112 and fixed ring 372 which is formed separate from annular race 371 and fitted against the axial rear end surface of annular projection 112. Fixed ring 372 is secured to the axial rear end surface of annular projection 112 by pins 373 and covers the end surface of fixed race 371. The orbital portion of rotation preventing/thrust bearing device 37 includes an annular orbital race 374 placed within an annular groove formed on the front surface of end plate 271 and an orbital ring 375 which is formed separately from orbital race 374 and fitted against the front surface of orbital race 374. Orbital ring 375 is fixed on circular end plate 271 by pins 376 and radially extends beyond the front outer radial end surface of orbital race 374.

Fixed ring 372 and orbital ring 375 each have a plurality of holes or pockets **372*a* and 375*a*. Pockets 372*a* within fixed ring 372 correspond in location to pockets 375*a* within orbiting ring 375 so that at least each pair of pockets facing each other have the same pitch, and the radial distance of the pockets from the center of their respectively rings 372 and 375 is the same. The center of pocket 372*a* is offset from the center of pocket 375*a* by an amount equal to the radius of the pockets. Balls 377 are placed between the edge of pockets 372*a* of fixed ring 372 and the edge of pockets 375*a* of orbital ring 375**.

During the operation of the scroll type compressor, balls 377 roll along the edge of pockets **372*a*, 375*a*. Thus, rotating motion of orbiting scroll 27 is prevented while its angular relationship with fixed scroll 26** is maintained.

Rotation preventing/thrust bearing device 37 typically includes a large number of balls 377. This is desirable so that the thrust load from the orbiting scroll is adequately absorbed. In the assembly process of the compressor, each of balls 377 must be placed between respective pockets **372*a* and 375*a*, during which balls 377 sometimes roll or are accidentally dropped into hollow portion 50. When this happens, a worker assembling the compressor often cannot detect such misassemblies. One solution is to design the compressor so that the axial length A (FIG. 3) is smaller than the diameter D of balls 377. When so designed, the front end plate 11 and orbiting scroll 27 will be misaligned if joined when a ball or balls 377 have fallen into hollow portion 50**.

The misalignment, however, is extremely small. Consequently, the worker sometimes fails to detect the misassembly and proceeds to the next step of the assembly process. Furthermore, the relationship between axial length A and diameter D must be accurately determined, which in turn increases the manufacturing costs. Finally, sometimes it is necessary to modify the size and weight of the balance weight depending on the particular scroll configuration. Such modifications will necessarily have to take into account any changes made to axial length A and diameter D, thereby complicating design changes.

SUMMARY OF THE INVENTION

It is an object of the invention to provide a rotation preventing/thrust bearing device for a scroll type fluid displacement apparatus wherein assembly is easily and precisely performed.

It is another object of the present invention to provide a scroll type fluid displacement apparatus which allows changes in the scroll configuration.

A scroll type fluid displacement apparatus according to the preferred embodiments includes a housing having a fluid inlet port and fluid outlet port. The housing comprises a cup shaped portion and a front end plate portion having a hollow portion formed in a center thereof. A fixed scroll is secured to the cup shaped portion and has an end plate from which a first wrap extends. An orbiting scroll, which has an end plate from which a second wrap extends, is interfitted with the fixed scroll.

A driving mechanism includes a drive shaft rotatably supported by the end plate. A drive pin eccentrically extends from an inner end of the drive shaft. The drive shaft is drivingly connected to the orbiting scroll through the drive pin. A balance weight member is disposed within the housing and extends radially from the bushing. The balance weight member causes a centrifugal force to counterbalance the centrifugal force which arises by the orbiting motion of the orbiting scroll and the parts of the apparatus which orbit with the orbiting scroll.

A rotation prevention means includes a fixed ring member attached to an inner surface of the front end plate and an orbital ring attached to the circular end plate of the orbiting scroll. The fixed and orbital rings have a plurality of facing pockets within which a plurality of balls are disposed.

The front end plate includes an annular surface having at least one recessed portion therein. The recessed portion captures any ball which may have rolled out of the rotation prevention means into the hollow portion. When disposed in the recessed portion, the drive shaft is prevented from rotating due to balance weight member striking the ball within the recessed portion. Therefore, a defectively assembled compressor is easily detected during the assembly process.

Further objects, features and other aspects of this invention will be understood from the following detailed description of the preferred embodiments when read in conjunction with the annexed drawings.

DETAILED DESCRIPTION OF THE PREFERRED EMBODIMENTS

Figure 1:
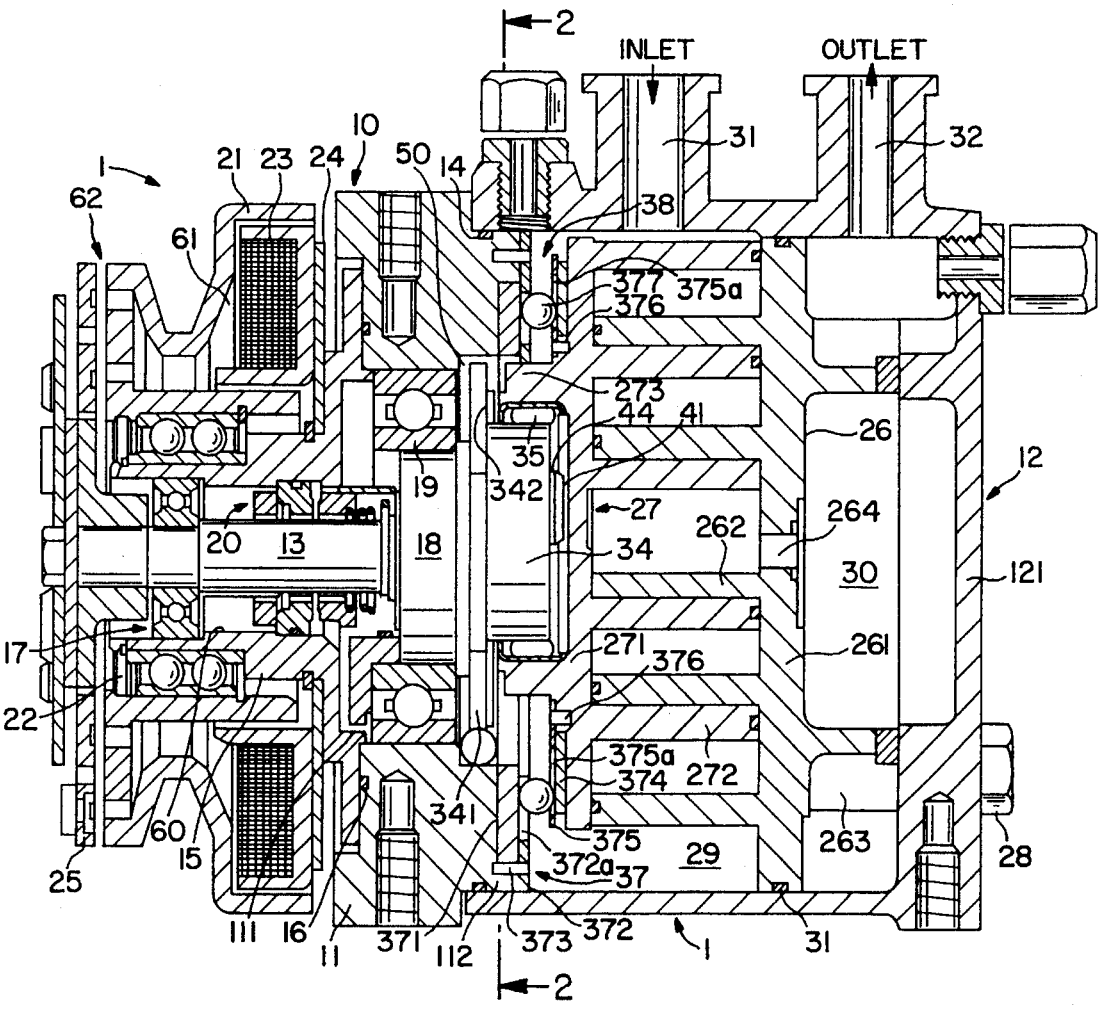
FIG. 1 (PRIOR ART)
FIG. 1 is a cross-sectional view of a scroll compressor in accordance with the prior art.
Figure 2:
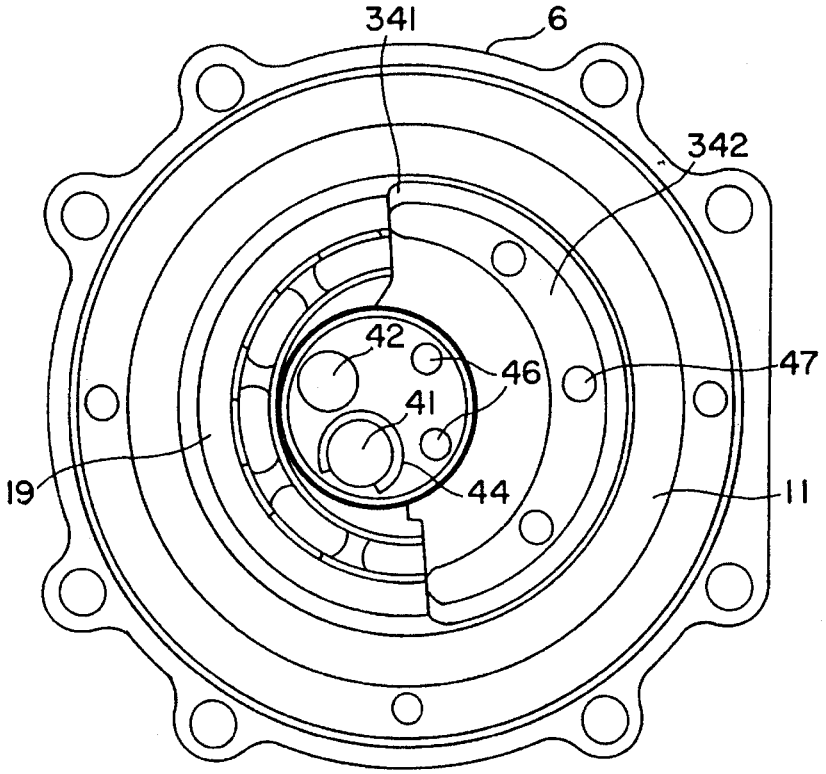
FIG. 2 (PRIOR ART)
FIG. 2 is a cross-sectional view taken along line 2—2 of FIG. 1.
Figure 3:
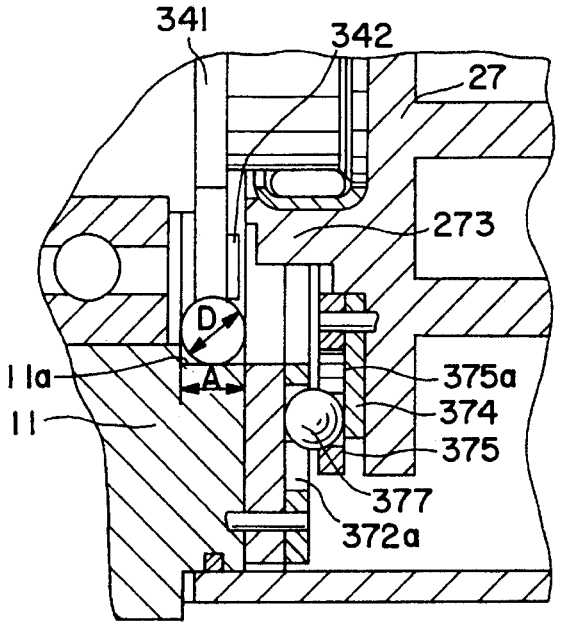
FIG. 3 (PRIOR ART)
FIG. 3 is an expanded cross-sectional view illustrating a prior art rotation preventing/thrust bearing device.

The following embodiments illustrated in FIGS. 4–10 use the same numerals as shown in FIGS. 1, 2, and 3, so an explanation of similar elements is omitted.

Figure 4:
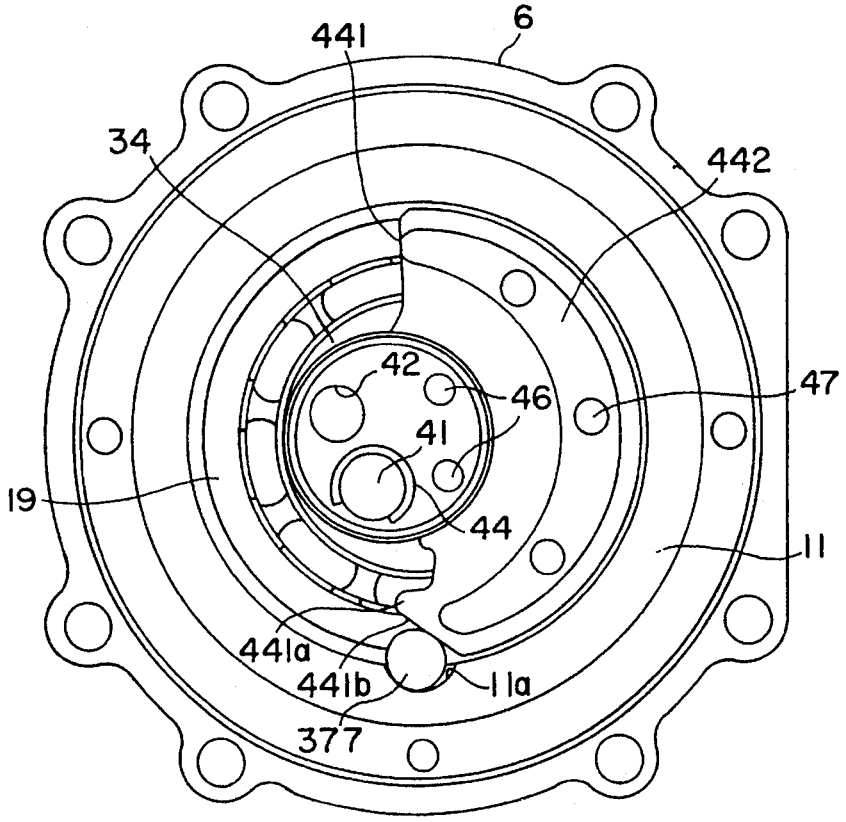
FIG. 4 is a cross-sectional view, similar to the view taken along line 2—2 of FIG. 1, showing a first preferred embodiment.
Figure 5:
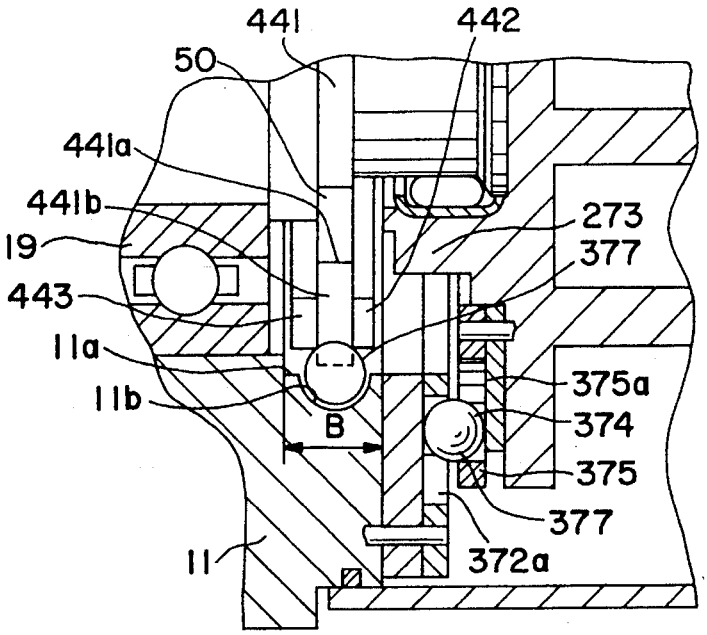
FIG. 5 is an expanded cross-sectional view of an inspection system in accordance with a first preferred embodiment.
Figure 6:
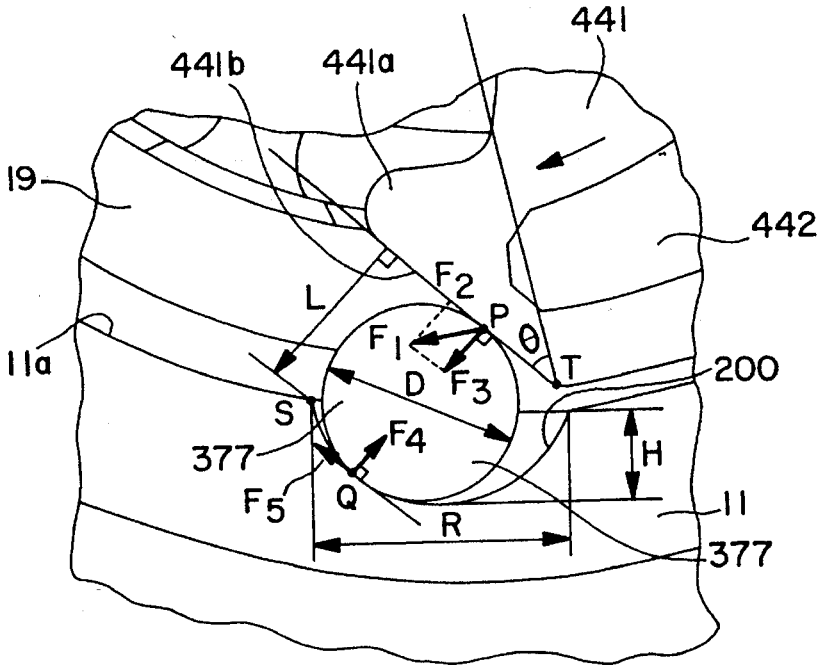
FIG. 6 is a schematic illustrating various forces acting upon a ball in a defectively assembled compressor.

FIGS. 4, 5 and 6 illustrate a first preferred embodiment for the inspection system. Front end plate 11 includes annular surface 11*a*, and at least one recessed portion 200 formed as a half-sphere in annular surface 11*a*. Recessed portion 200 accomodates balls 377 which might roll out of rotation preventing/thrust bearing device 37 into hollow portion 50 when the compressor is misassembled. Axial width B (FIG. 5) of annular surface 1 la is larger than the diameter of ball 377. Recessed portion 200 is designed such that when seated therein, balls 377 project above annular surface 11*a*. Balance weight 441 includes a triangular-shaped end portion 44 la and a straight surface portion 441*b* which is axially inclined. When ball 377 is positioned in hollow portion 50, the straight surface portion 441*b* strikes ball 377, causing ball 377 to roll into recessed portion 200 while balance weight 441 rotates therebehind. Balance weight 44 1 pushes ball 377 to the bottom of recessed portion 200, whereby ball 377 locks into place and stops the rotation of balance weight 441.

With reference to FIG. 6, the forces acting between balance weight 441 and ball 377 are shown. When ball 377 contacts balance weight 441 at point P and recessed portion 200 at point Q, several forces are produced. F1 represents the resultant force due to the torque of drive shaft 13 and acts in the direction of rotation of balance weight 441. F2 represents the frictional component of F1 and acts tangent to the surface of ball 377. F3 represents the component of F1 acting normal to the surface of ball 377. F4 represents the reaction force of recessed portion 200. F5 represents the frictional force created between the surface of recessed portion 200 and ball 377.

The depth H and diameter R of recessed portion are depicted in FIG. 6. Diameter R is larger than diameter D of ball 377. An angle θ is defined between straight surface portion 441*b* and a line drawn from the center of balance weight 441 to radial end point T of balance weight 441.

Figure 7:
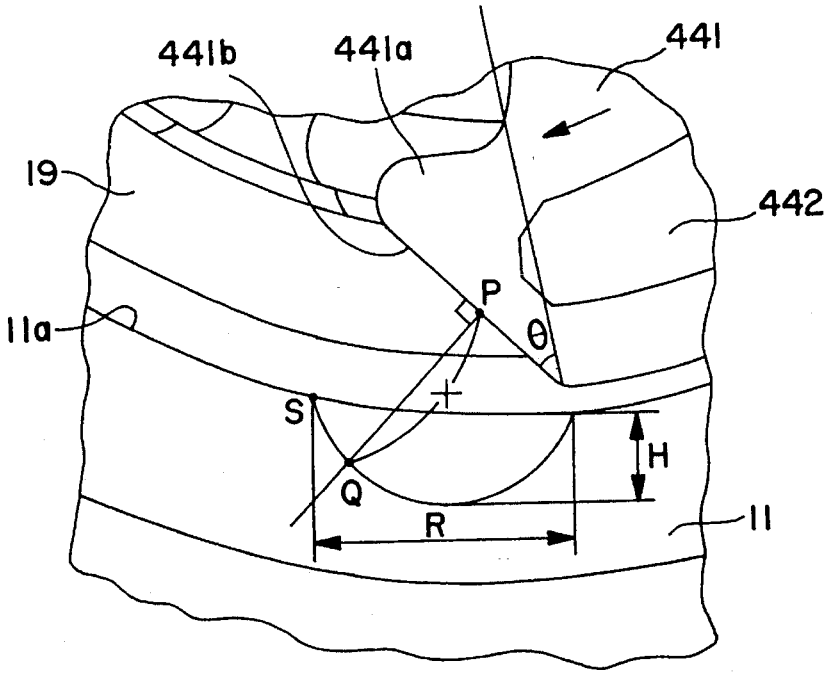
FIG. 7 is a diagrammatic enlarged view of FIG. 6.

With reference to FIG. 7, a point P, which represents the point of contact between straight portion 441*b* and ball 377, moves along straight portion 441*b* according to the rotating motion of balance weight 441. Point Q represents the point of rolling contact between ball 377 and recessed portion 200. The distance between point P and Q is defined by X. When distance X is equal to diameter D of ball 377, ball 377 becomes locked between recessed portion 200 and the contacting straight edge portion 441*b* of balance weight 441. When this happens, the following formulas are realized.

$$|F1|^2=|F2|^2+|F3|^2,\ |F3|=|F4|,\ |F2|=|F5|$$

Consequently, the rotation motion of balance weight 441 is prevented.

Recessed portion 200 joins annular surface 11*a* at point S. Point S is spaced from straight portion 441*b* by the distance defined as perpendicular line L. Angle θ may be about 30°–60° and preferably about 45°. Depth H of recessed portion 200 may be about half the diameter of ball 377 and preferably larger than half the diameter of ball 377.

When constructed as set forth above, even if balls 377 rolled out of rotation preventing/thrust bearing device 37 into hollow portion 50, or are accidentally dropped into hollow portion 50, the defect is easily detected. Further, in this arrangement, the design of balance weight 441 may be readily modified to account for changes in the dynamic and static balance when new or modified components are introduced into the scroll design. For example, width B (FIG. 5) can be the same as or larger than diameter D of balls 377.

Figure 8:
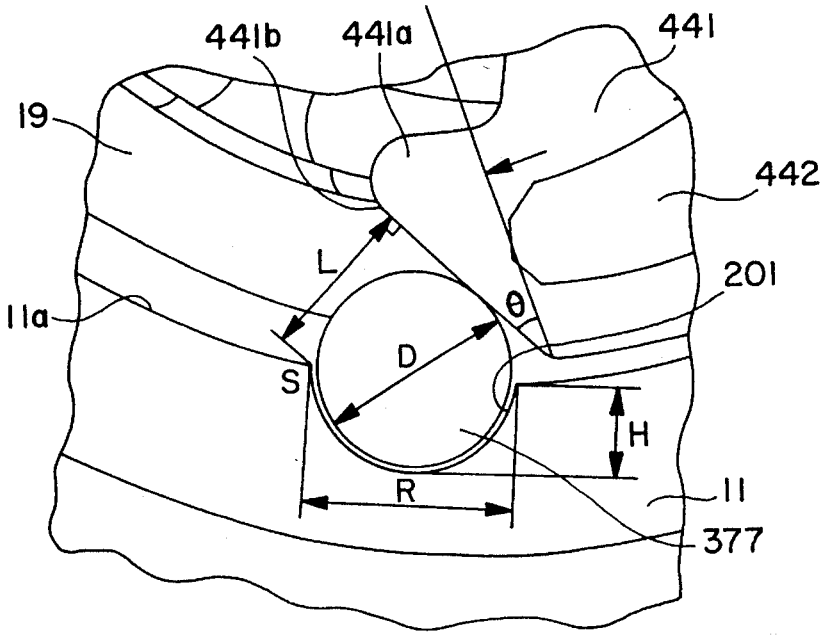
FIG. 8 is an enlarged view of an inspection system in accordance with a second preferred embodiment.

FIG. 8 illustrates a second preferred embodiment. In this embodiment, diameter R of recessed portion 201 is nearly equal to but slightly larger than the diameter D of ball 377. The other parts of the compressor, such as balance weight 441, are substantially the same as the parts of the first preferred embodiment. As with the first preferred embodiment, when a ball 377 is positioned in hollow portion 50, it is pushed by balance weight 441 into recessed portion 201. Ball 377 then locks into place, thereby preventing further rotation of balance weight 441.

Figure 9:
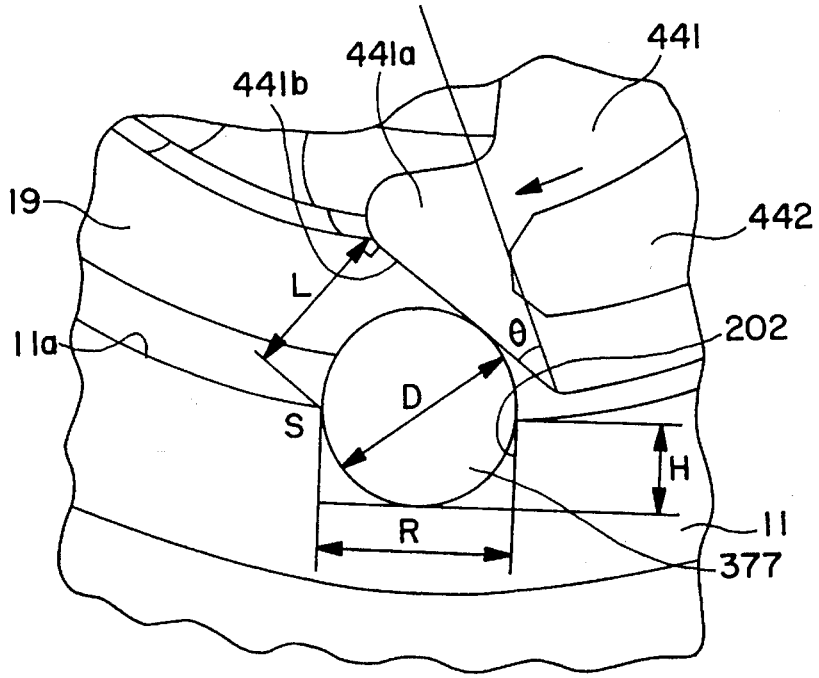
FIG. 9 is an enlarged view of an inspection system in accordance with a third preferred embodiment.

FIG. 9 illustrates third preferred embodiment. In this embodiment, end plate 11 includes cylindrical recessed portion 202. The diameter R of recessed portion 202 is substantially the same as the diameter D of ball 377. The other parts of the compressor, such as balance weight 441, are substantially the same as the parts of the previous embodiments, and the operation of the inspection system is substantially the same.

Figure 10:
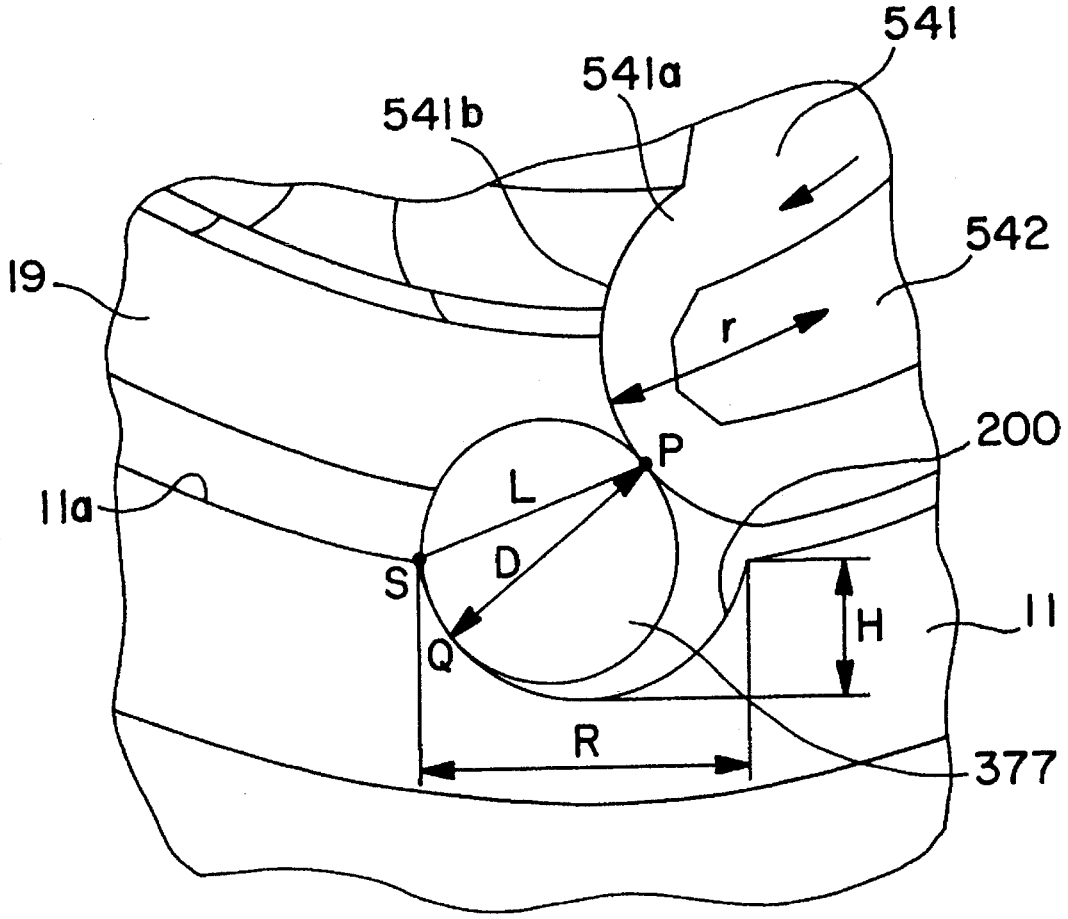
FIG. 10 is an enlarged view of an inspection system in accordance with a fourth preferred embodiment.

FIG. 10 illustrates a fourth preferred embodiment. In this embodiment, balance weight 541 includes end portion 541*a* shaped as a half circle and a curved edge surface portion 541*b* which contacts the surface of ball 377. Edge surface portion 541*b* has a radius of curvature r which is preferably larger than the diameter D of ball 377. The other parts of the compressor, such as recessed portion 200, are substantially the same as the parts of the previous embodiments. However, in this embodiment, ball 377 locks between recessed portion 200 and curved edge surface portion 541*b* when the points of contact between ball 377 and balance weight 541 and recessed portion 200 are aligned along line L between points P and S.

The functions and effects of the second through fourth embodiments are substantially the same as the functions and the effects of the first embodiment, so an explanation thereof is omitted.

This invention has been described in connection with the preferred embodiments. These embodiments, however, are merely exemplary and the invention is not restricted thereto. It will be easily understood by those skilled in the art that variations can be easily made within the scope of this invention as defined by the claims.

I claim:

1. A scroll type fluid displacement apparatus comprising:

a housing having a fluid inlet port and fluid outlet port, said housing divided into a first housing portion and a second housing portion, said second housing portion having a hollow portion formed therein, said hollow portion defining a first radial length and being radially surrounded by an end portion of said second housing portion;

a fixed scroll fixedly disposed relative to said first housing portion and having an end plate from which a first wrap extends;

an orbiting scroll having an end plate from which a second wrap extends, said first and second wraps interfitting at an angular and radial offset to form a plurality of line contacts to define at least one pair of sealed off fluid pockets;

a driving mechanism including a drive shaft rotatably supported by said housing and a drive pin eccentrically extending from an inner end of said drive shaft;

a balance weight member operatively coupled to and swingable about said drive pin, said balance weight member located in said hollow portion of said second housing portion, said balance weight member including a radial end portion which when said balance weight member swings about said drive pin describes a second radial length, said first radial length being greater than said second radial length;

rotation preventing means for preventing the rotation of said orbiting scroll during orbital motion thereof, said rotation prevention means including a fixed ring member attached to an inner surface of said second housing portion and an orbital ring attached to an axial end surface of said orbiting scroll, said fixed and orbital rings having a plurality of facing pockets within which a plurality of balls are disposed; and at least one recessed portion formed in said second housing portion adjacent said hollow portion, said recessed portion being at least large enough to accommodate one of said balls so that when one of said balls is disposed within said recessed portion, said ball protrudes inside of said second radial length and said radial end portion of said balance weight member strikes said ball and prevents the further rotation of said balance weight member.

2. The scroll type compressor recited in claim 1 wherein said recessed portion is shaped as a half-sphere.

3. The scroll type compressor recited in claim 1 wherein said recessed portion has a cylindrical shape.

4. The scroll type compressor recited in claim 1 wherein said radial end of said balance weight member comprises a straight end portion for contacting said ball.

5. The scroll type compressor recited in claim 4 wherein said straight end portion of said radial end of said balance weight member is inclined so as to push said ball into and retain said ball within said recessed portion.

6. The scroll type compressor recited in claim 1 wherein said radial end of said balance weight member comprises a curved portion for contacting said ball.

7. A scroll type fluid displacement apparatus comprising:

a housing divided into a first housing portion and second housing portion having a hollow portion formed in a center thereof, said hollow portion defining a first radial length and being radially surrounded by a radial end portion of said second housing portion;

a fixed scroll fixedly disposed relative to said first housing portion and having an end plate from which a first wrap extends;

an orbiting scroll having an end plate from which a second wrap extends, said first and second wraps interfitting at an angular and radial offset to form a plurality of line contacts to define at least one pair of sealed off fluid pockets;

a drive shaft rotatably supported by said housing, said drive shaft having a disk at an inner end thereof, and clutch means coupled at an opposite end thereof for selectively connecting said drive shaft to a power source;

a balance weight operatively coupled to said drive shaft and at least partially extending into said hollow portion of said second housing portion, said balance weight member including a radial end portion which when said balance weight member swings about said drive shaft describes a second radial length, said first radial length being greater than said second radial length;

rotation preventing means for preventing the rotation of said orbiting scroll during orbital motion thereof, said rotation prevention means including a fixed ring member attached to an inner surface of said second housing portion and an orbital ring attached to an axial end surface of said orbiting scroll, said fixed and orbital rings having a plurality of facing pockets within which a plurality of balls are disposed; and means, formed in said second housing portion adjacent said hollow portion, for preventing the rotation of said drive shaft when any of said plurality of balls enters said hollow portion, said preventing means trapping one of said balls such that said one of said balls protrudes inside of said second radial length and said radial end portion of said balance weight member strikes said one of said balls and prevents further rotation of said balance weight member.

8. The scroll type compressor recited in claim 7 wherein said preventing means comprises a recessed portion formed in said second housing portion, said recessed portion having a half-sphere shape.

9. The scroll type compressor recited in claim 7 wherein said preventing means comprises a recessed portion formed in said second housing portion, said recessed portion having a cylindrical shape.

10. The scroll type compressor recited in claim 7 wherein said balance weight member comprises a straight edge portion at a radial end thereof for contacting said ball.

11. The scroll type compressor recited in claim 10 wherein said straight edge portion of said radial end of said balance weight member is axially inclined so as to push said ball into and retain said ball within said preventing means.

12. The scroll type compressor recited in claim 7 wherein said balance weight member comprises a curved edge portion at a radial end thereof for contacting said ball.

* * * * *